United States Patent [19]

Bradshaw et al.

[11] 4,226,547

[45] Oct. 7, 1980

[54] PRINTING CARTRIDGE

[75] Inventors: Franklin C. Bradshaw, St. Paul; Thomas P. Connoy, Lino Lakes; Michael W. Paque, Stillwater, all of Minn.

[73] Assignee: Kroy Industries Inc., Stillwater, Minn.

[21] Appl. No.: 922,565

[22] Filed: Jul. 7, 1978

[51] Int. Cl.[3] ..... B41J 15/04; B41J 32/00

[52] U.S. Cl. ..... 400/613; 400/207; 400/134.6; 242/71.2; 242/75.4; 220/339; 206/391

[58] Field of Search ..... 400/88, 134.6, 613, 400/207–209, 697, 697.1; 354/5, 14, 19; 242/71.2, 75.4; 206/391; 220/339

[56] References Cited

U.S. PATENT DOCUMENTS

| | | | |
|---|---|---|---|
| 2,107,603 | 2/1938 | Ellenburg | 242/55.3 |
| 2,329,129 | 9/1943 | Mehan | 400/208 |
| 2,647,577 | 8/1953 | White | 206/391 |
| 2,668,021 | 2/1954 | Gleason | 242/71.2 |
| 2,930,469 | 3/1960 | Roggenstein | 400/208.1 |
| 3,342,293 | 9/1967 | Whitesel | 400/615.2 |
| 3,799,315 | 3/1974 | Stewart | 400/208 |
| 3,804,351 | 4/1974 | Kaneko et al. | 242/71.2 |
| 3,834,507 | 9/1974 | Bradshaw | 400/615.2 |
| 3,904,017 | 9/1975 | Frechette | 400/697.1 |
| 3,912,064 | 10/1975 | Bluem et al. | 400/134.6 |
| 4,011,940 | 3/1977 | Neal et al. | 220/339 |
| 4,015,700 | 4/1977 | Pagne | 400/617 |
| 4,058,197 | 11/1977 | West | 242/75.4 |
| 4,088,218 | 5/1978 | Depen | 400/208 |
| 4,124,172 | 11/1978 | Verch | 242/75.4 |

*Primary Examiner*—William Pieprz

*Attorney, Agent, or Firm*—Dorsey, Windhorst, Hannaford, Whitney & Halladay

[57] ABSTRACT

A printing cartridge for supplying tape and ribbon in a printing apparatus in which the tape and ribbon is advanced by reciprocal movement of the cartridge carrier toward and away from the printing station. The printing cartridge includes a cartridge housing, a spool of image carrying tape and a spool of printing ribbon, both rotatably supported within the housing, a guide means for guiding the tape and ribbon from the cartridge toward the printing station and a means for creating a braking action with respect to the tape and the ribbon for resisting free movement thereof from said tape cartridge.

28 Claims, 9 Drawing Figures

PRINTING CARTRIDGE

BACKGROUND OF THE INVENTION

The present invention relates generally to an improved tape-ribbon cartridge and more specifically, to an improved tape-ribbon cartridge adapted for use in a printing apparatus or composing system. The present cartridge has particular application in a printing apparatus or composing system having a cartridge carrier and in which the means for advancing the tape and ribbon past the printing station includes means for reciprocally moving the cartridge carrier, and thus the cartridge, toward and away from said printing station.

Ribbon cartridges such as those used in typewriters have existed in the art for many years. Many of these include only a supply spool of typewriter ribbon, while others include both a supply and take-up spool for the ribbon. They all, however, provide only a typewriter ribbon supply. None is designed to supply both a printing ribbon and the medium on which the characters or letters are typed. Thus, the advancement of the ribbon is not particularly critical to the spacing of the characters being typed. In prior art dry lettering systems, such as those illustrated and described in U.S. Pat. Nos. 3,834,507, 3,912,064 and 4,015,700 and pending U.S. patent application Ser. No. 726,106 filed Sept. 24, 1976, in which both a printing ribbon and image carrying tape are used, the ribbon and tape are supplied from separate spools which are rotatably mounted and generally fixed with respect to the apparatus. None of the ribbon or tape supply means in any of these patents, however, shows the ribbon and tape supplied from a single cartridge. Some even fail to show any kind of tape or ribbon cartridge. Because of this, replacing supplies, ribbons and tapes in these dry lettering systems requires a reasonable level of skill and understanding of the equipment and takes valuable and otherwise productive time of the operator. Accordingly, there is a real need in the art for a printing cartridge which not only supplies the ribbon and tape in a dry lettering system, but which supplies such ribbon and tape from the same cartridge.

SUMMARY OF THE INVENTION

In contrast to the prior art, the present invention relates to an improved combination ribbon-tape cartridge which supplies both the tape and ribbon from the same cartridge and which is adapted for use in a dry lettering printing or composing system. The cartridge has particular application in a dry lettering system in which the tape and ribbon are advanced by reciprocal movement of the cartridge toward and away from the printing station. The cartridge of the present invention includes a generally rectangular cartridge housing and an elongated tape-ribbon guide integrally hinged with the cartridge housing for guiding and supplying the tape and ribbon to the printing station. The tape-ribbon guide portion includes an improved drag or braking means to prevent the tape and ribbon from being freely pulled or removed from the cartridge and to permit the tape and ribbon to be moved toward the printing station and in printing alignment thereof by movement of the cartridge itself. The improved drag or breaking means includes a rib member integrally formed with a portion of the tape-ribbon guide means and a flexible divider disposed between opposing portions of the tape-ribbon guide member and between the tape and ribbon. This divider, in combination with the rib, functions to bend the tape slightly so that its engagement with various surfaces throughout its movement through the guide member creates the necessary drag or braking action.

Accordingly, a primary object of the present invention is to provide improved means for supplying tape and ribbon in a dry lettering system.

Another object of the present invention is to provide an improved tape-ribbon cartridge for supplying tape and ribbon with a single cartridge in a dry lettering system.

A further object of the present invention is to provide a tape-ribbon cartridge for use in a dry lettering system having improved drag or braking means for preventing the free, unresisted supply of tape ribbon from the cartridge.

Another object of the present invention is to provide an improved tape-ribbon cartridge usable in a dry lettering system in which the tape and ribbon are advanced into printing alignment with the printing station by corresponding movement of the cartridge itself.

These and other objects of the present invention will become apparent with reference to the drawings, the description of the preferred embodiment and the appended claims.

DESCRIPTION OF THE PREFERRED EMBODIMENT

Figure 1:
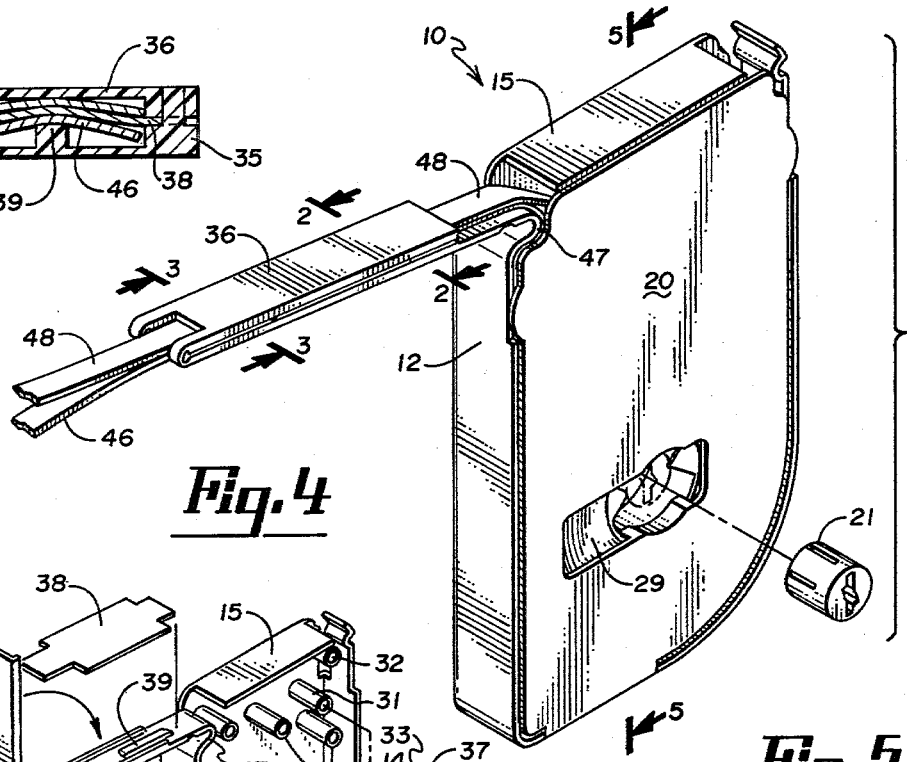
FIG. 1 is a pictorial view of the improved cartridge of the present invention.
Figure 4:
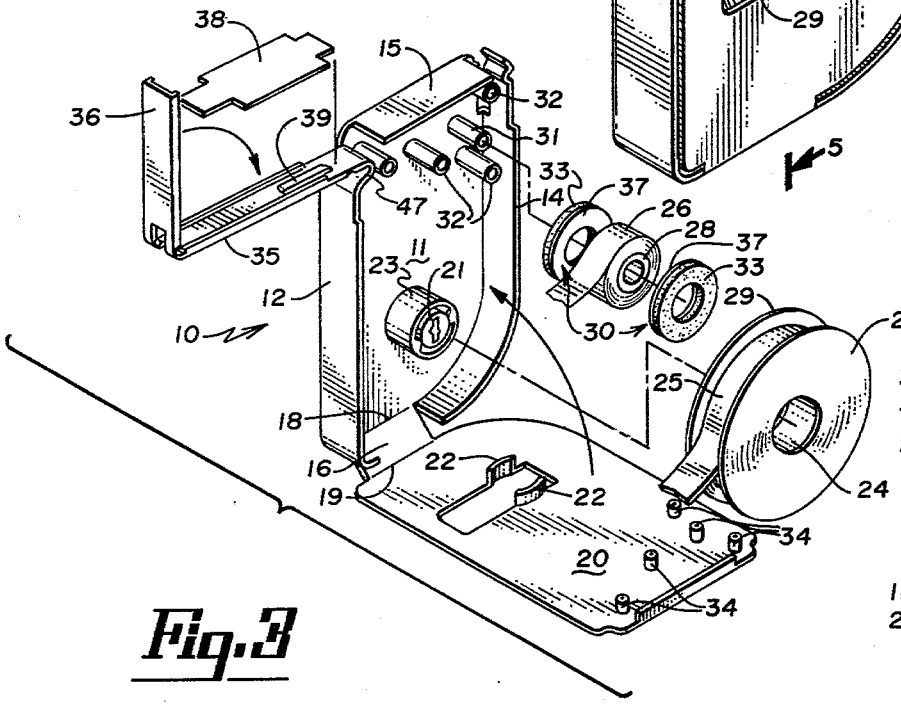
FIG. 4 is an exploded pictorial view of the cartridge of the present invention.

Reference is first made to FIGS. 1 and 4. FIG. 1 is a pictorial view of the present cartridge in its totally assembled form; FIG. 4 is an exploded view of the cartridge showing the various individual components of the cartridge and their relationship with one another. The cartridge includes a generally rectangular cartridge housing having a pair of side walls 12 and 14, a top wall 15, a botom wall 16 and front and back surfaces, 20 and 11, respectively. As illustrated in FIG. 4, the entire cartridge 10 including the cartridge housing is constructed of a single piece of molded plastic or other similar material. Each of the walls 12, 14 and 15 is integrally formed at generally right angles with respect to the back surface 11, while the bottom surface 16 and the front surface 20 are molded in a plane generally parallel to that of the surface 11. As shown, the bottom surface 16 is integrally hinged along the lines 18 and 19 to portions of the surfaces 11 and 20, respectively. These integral hinges are formed by reducing the thickness of the plastic along these lines.

The side wall 12 extends from near the top of the cartridge 10 and defines one side thereof. The lower end of the side 12 terminates in abutting relationship with one edge of the bottom surface 16 when the cartridge is assembled. The side wall 14 also extends from near the top of the cartridge and defines the opposite side of the cartridge. The lower end of the side wall 14 extends downwardly and curves inwardly where it terminates in abutting relationship to the other edge of the bottom surface 16 when the cartridge is assembled. The surface 15 is at right angles with the back surface 11 and defines the top portion of the cartridge housing generally between the upper ends of the surfaces 12 and 14.

Figure 5:
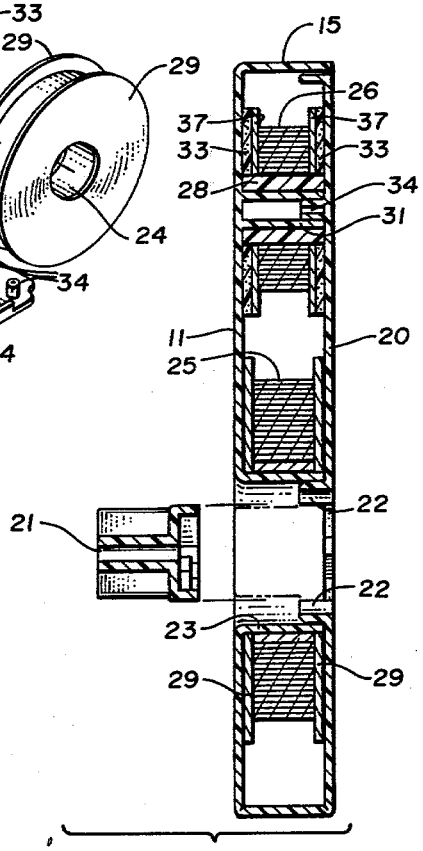
FIG. 5 is a cross-sectional view of the cartridge of the present invention as viewed along the section line 5—5 of FIG. 1.
Figure 6:
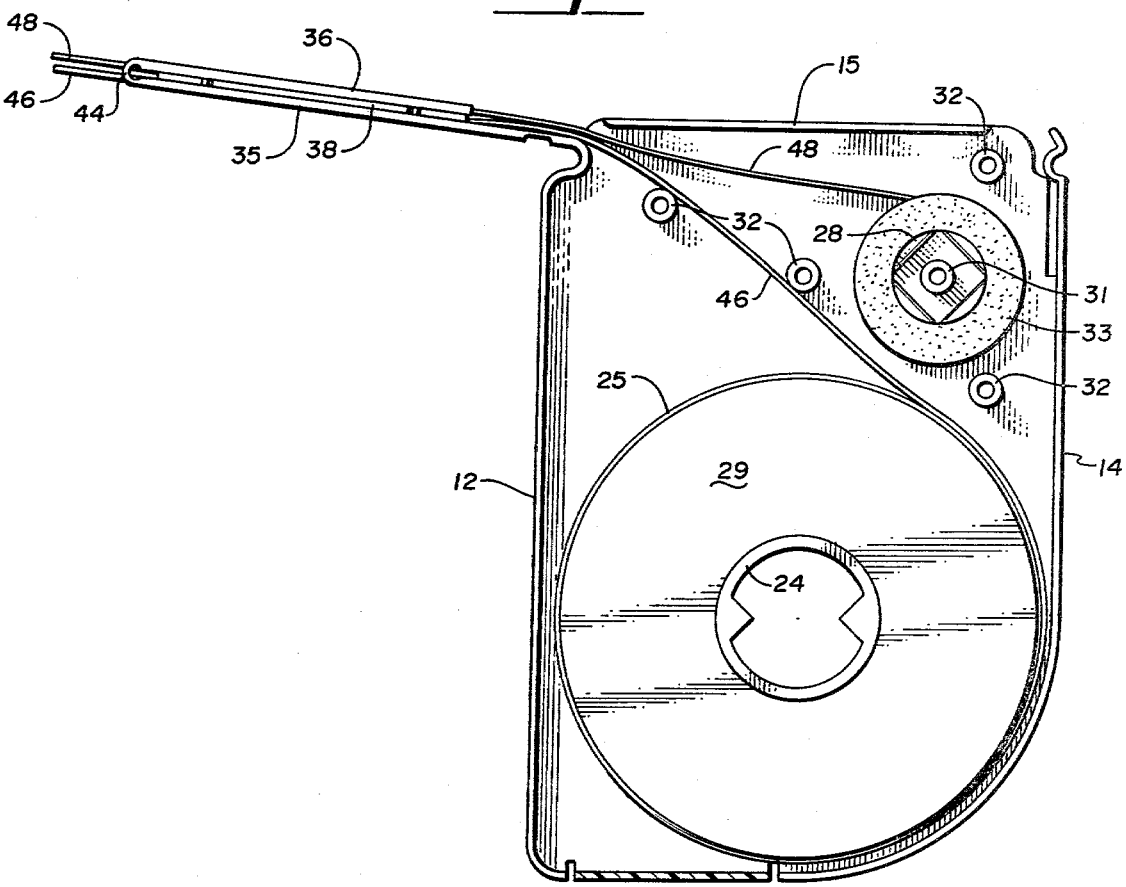
FIG. 6 is an elevated view of the cartridge of the present invention with the front side removed.

The back or rear surface of the cartridge housing 11 includes a generally cylindrical tape spool support 23 which is integrally formed with the surface 11 and extends outwardly at right angles thereto as illustrated in FIGS. 4 and 5. The spool support 23 is adapted for supporting a spool of tape 25 (FIGS. 5 and 6). The rear surface 11 also includes a generally cylindrical ribbon spool support 31 integrally formed with the surface 11 and extending outwardly therefrom at generally right angles. The support 31 is adapted for supporting a spool of ribbon 26 as illustrated in FIGS. 5 and 6.

The rear surface 11 further includes a plurality of female retaining and alignment posts 32 integrally formed with the surface 11 and extending outwardly therefrom at right angles. Each of these female alignment posts 32 is generally cylindrically shaped and adapted for engagement with a corresponding male alignment post 34 integrally formed with the surface 20. The posts 34 are adapted for insertion into the cylindrical openings in the female posts 32 to properly align the surface 11 with respect to the surface 20 and to retain the two surfaces in their assembled position as illustrated in FIGS. 1 and 5. The surface 20 includes a pair of spool support alignment tabs 22 integrally formed with the surface 20 and extending at right angles outwardly therefrom. These alignment tabs are adapted for association with the spool support 23. When the cartridge is assembled, the tabs 22 are positioned on the inside surface of the spool support 23 as illustrated best in FIG. 5.

With reference to FIGS. 4, 5 and 6, a spool of image carrying tape 25 is mounted on the spool support 23. The tape 25 includes a center spool portion 24 which in the preferred embodiment is constructed of a material such as compressed cardboard. The spool 24 is mounted on the spool support 23 so that the tape 46 (FIG. 6) is fed therefrom as illustrated in FIG. 6. A pair of release discs 29 are associated with the spool of tape 25 to prevent the tape from rubbing against the inside surface 11 and 20 and to prevent the spool of tape from sticking to the cartridge. One of these discs 29 is positioned on each side of the tape spool 25 when the spool is in its assembled position. In the preferred embodiment, the discs 29 are constructed of a thin cardboard or heavy stock paper material which may be coated with silicone or some similar material to prevent the tape from sticking to it.

The ribbon 48 is fed from a spool of ribbon 26 which includes a spool element 28 mounted for rotational movement about the ribbon spool support 31. The spool of ribbon 26 also includes a pair of brake or drag elements 30. One of the elements 30 is disposed on each side of the spool of ribbon 26 between such spool and the surfaces 11 and 20. The elements 30 function to induce drag on the ribbon to create tension required for proper feeding of the ribbon. The elements 30 also center the ribbon spool so the ribbon tracts properly. As illustrated best in FIG. 4 of the preferred embodiment, each of the members 30 includes a thin annular piece of paper material 37 and a thicker annular piece of foam material 33 secured to the paper 37. The paper 37 is intended to engage the outer surface of the spool of ribbon 26 while the foam surface 33 is intended to engage the cartridge surfaces 11 and 20. The inner surface of the paper material 37 in contact with the spool 26 can be coated with a silicone or similar material to avoid abrasion of the ribbon. Both the tape and ribbon feed from their respective spools in a counterclockwise direction as viewed in FIG. 6.

Figure 7:
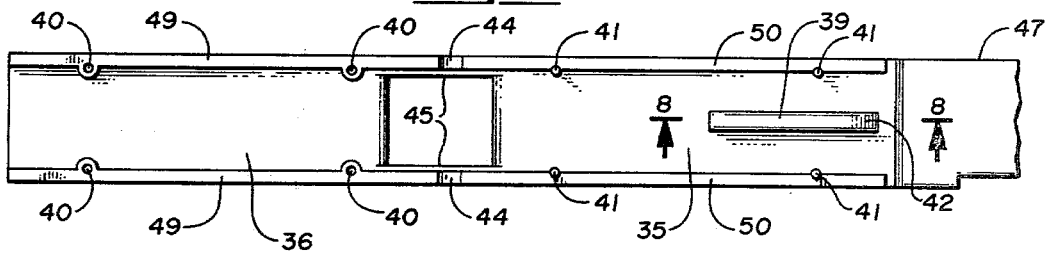
FIG. 7 is an elevated view of the tape-ribbon guide means with both sections of the guide means opened up.
Figure 8:
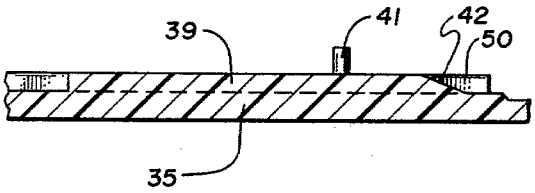
FIG. 8 is a sectional view of the drag rib as viewed along the section line 8—8 of FIG. 7.

Integrally formed with the top end of the side wall 12 in a hinged relationship is a tape and ribbon guide and alignment means for guiding the tape and ribbon 46 and 48 from the cartridge to the printing station of the lettering apparatus (not shown). As illustrated best in FIGS. 4 and 7, the guide means is comprised of a pair of elongated, opposing guide members 35 and 36 which are integrally joined together by the hinge 44 (FIG. 7). The guide member 35 includes a generally flat center portion and a pair of raised edges 50 extending along each side thereof. Positioned in spaced relationship along the raised edge or shoulder 50 are a plurality of alignment and retaining male posts 41 adapted for cooperation with corresponding female alignment members 40 on the member 36 to properly align the guide members 35 and 36 with respect to each other and to secure the same together. The member 35 also includes a rib section 39 disposed in the center of the flat portion and extending generally along the longitudinal axis of the member 35. As shown in FIG. 8, the rib 39 is raised from the flat surface of the member 35 and extends approximately $\frac{1}{3}$ to $\frac{1}{2}$ of the distance along the length of the member 35. As will be described in more detail below, the rib 39 functions to increase the drag or braking action on the tape 46 passing through the guide means and to prevent the same from being freely pulled from the cartridge 10. The right hand end of the member 35 as illustrated in FIG. 7 is integrally formed with the top portion of the side wall 12 by an integral hinge portion 47 which allows the tape-ribbon guide to be pivoted to a limited extent relative to the main body of the cartridge. The hinge 47 is formed as a result of reduced areas of plastic.

The guide member 36 includes a generally flat central surface portion and a pair of side edges 49 raised above the flat surface. Spaced from each other within the edge portions 49 are a plurality of female alignment members 40 adapted for engagement with the corresponding male alignment members 41 of the member 35. The members 35 and 36 are joined by the integral hinges 44. Disposed between the hinges 44, as best shown in FIG. 7 are a pair of inner guide surfaces 45 which approximate the width of the tape 46 supplied from the cartridge. When the cartridge is fully assembled, the surfaces 45 serve as a tape guiding and alignment means.

Figure 2:
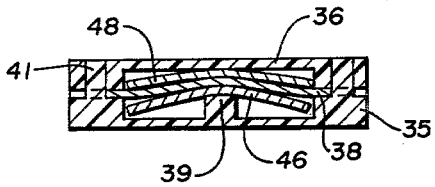
FIG. 2 is a cross-sectional view of the tape-ribbon guide means of the present cartridge as viewed along the section line 2—2 of FIG. 1.
Figure 9:
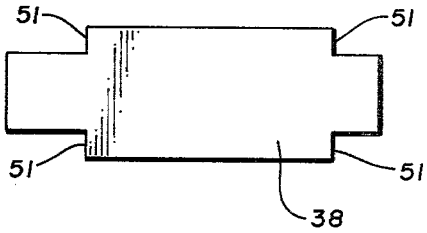
FIG. 9 is a plan view of the divider of the tape-ribbon guide means.

As illustrated in FIG. 4, the member 36 is intended to be pivoted clockwise about the hinges 44 and snapped into engagement with the lower guide member 35. A divider member 38 is disposed between the members 35 and 36 when assembled and is also disposed between the ribbon 48 and tape 46 as those members pass through the guide. As shown in FIG. 9, the divider 38 includes a plurality of shoulder portions 51 which, when assembled within the guide means, are disposed within the perimeter defined by the alignment posts 41 (FIG. 7). When the cartridge is assembled, the divider 38 is disposed between the opposing member 35 and 36 along the edges 49 and 50. In the preferred embodiment, the divider 38 is constructed of 94 pount paper which is preferably silicone coated on both sides or at least on the side contacting the ribbon so as to eliminate any abrasion against the ribbon surface. The divider 38, in combination with the rib member 39, causes a drag or braking action to be exerted on the tape member 46 as it passes through the guide means. As shown in FIG. 2, the rib 39 causes generally upward bending of both the divider 38 and the image carrying tape 46. This bending motion results in a drag or braking force being created between the rib 39 and the lower surface of the tape 46 and between various portions of the upper surface of the tape 46 and the lower surface of the divider 38.

It is also contemplated that such drag on the ribbon spool can be created by a spring steel washer positioned on one side of the ribbon spool and contacting only the spool.

Figure 3:
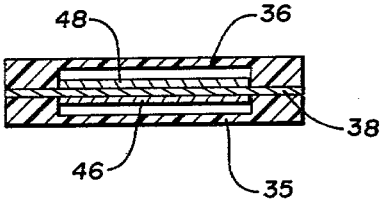
FIG. 3 is a cross-sectional view of the tape-ribbon guide means of the present invention as viewed along the section line 3—3 of FIG. 1.

As illustrated in FIG. 3 which is a cross-sectional view of the guide means ahead of the rib, portions of the upper surface of the tape 46 continue to engage opposing sides of the divider 38 to generate further drag or braking action. It should be noted that the magnitude of the drag or braking action on the tape is a function of the height of the rib 39 and the length of the divider 38. The higher the rib 39, the greater the drag. Similarly, the greater the length of the member 38, the greater the drag.

The cartridge of the present invention is intended to be used in a printing apparatus or lettering system in which the tape and ribbon is advanced by movement of the cartridge itself. In such apparatus, means is provided by which the tape and ribbon are clamped or prevented from moving during rearward movement of the cartridge away from the printing station of such apparatus. Thus, tape and ribbon are pulled from the cartridge during this rearward movement despite the drag or braking action within the guide means of the cartridge. After the cartridge reaches its rearwardmost position, the clamping action is released. Thus, upon forward movement of the cartridge toward the printing station, the tape and ribbon are advanced. Such advancement is insured as a result of the hinged connection 47 between the guide means and the main cartridge body. In this respect, the hinge 47 must be strong enough to transfer direct movement of the cartridge body to the guide means without loss of motion. Also, to get a full transfer of motion, the guide means should be disposed along a line generally parallel to the line of reciprocal back and forth movement of the cartridge.

Although the description of the preferred embodiment has been quite specific, it is contemplated that various other modifications can be made to the structure without deviating from the present invention. Therefore, it is intended that the scope of the present invention be dictated by the appended claims rather than by the description of the preferred embodiment.

I claim:

1. A printing cartridge for supplying tape and ribbon in a printing apparatus having a printing station, said printing cartridge comprising:

a cartridge housing;

a spool of image carrying tape rotatably supported within said housing;

a spool of printing ribbon rotatably supported within said housing;

a guide means comprising an elongated guide member integrally joined with said cartridge housing and extending outwardly therefrom for guiding said tape and ribbon, one above the other such that a first flat face of said tape is in face-to-face registration with a first flat face of said ribbon, from said cartridge toward the printing station of said printing apparatus;

means within said guide means for creating a drag on said tape and ribbon for resisting free movement of said tape and ribbon through said guide means; and means for maintainng separation between said first flat faces of said tape and ribbon during the passage thereof through a substantial portion of the length of said elongated guide member.

2. The printing cartridge of claim 1 wherein said elongated member includes an opening extending therethrough in the longitudinal direction of said elongated member for passage of said tape and ribbon.

3. The printing cartridge of claim 2 wherein said means for creating a drag on said tape and ribbon includes an elongated rib integrally joined with said elongated member, extending in the longitudinal direction of said elongated member and generally centrally disposed within said opening.

4. The printing cartridge of claim 3 wherein said means for creating a drag on said tape and ribbon further includes a generally flat divider retained within said opening and disposed between said tape and ribbon during their passage through said opening.

5. The printing cartridge of claim 1 wherein said elongated member is joined with said cartridge housing by an integral hinge portion and is adapted for limited pivotal movement with respect to said cartridge housing about said hinge portion.

6. The printing cartridge of claim 5 wherein said elongated member includes an opening extending therethrough in the longitudinal direction of said elongated member for passage of said tape and ribbon.

7. The printing cartridge of claim 6 wherein said guide means includes a pair of elongated guide sections joined together along their opposing longitudinal edges to define said opening therebetween.

8. The printing cartridge of claim 7 wherein said pair of guide sections are integrally joined at their ends remote from said cartridge housing by at least one integral end hinge portion.

9. The printing cartridge of claim 1 wherein said cartridge housing includes spool supports for each of said spools of tape and ribbon.

10. The printing cartridge of claim 9 wherein said spool support for one of said spools of tape and ribbon includes a generally cylindrical portion extending substantially through said cartridge housing.

11. The printing cartridge of claim 10 having a ribbon rewind spool removably connected with the interior surface of said cylindrical portion.

12. The printing cartridge of claim 1 wherein said cartridge housing includes top and bottom surfaces, a pair of side surfaces and front and back surfaces.

13. The printing cartridge of claim 12 wherein said top surface and said pair of side surfaces are integrally and rigidly joined with said back surface at right angles with respect thereto.

14. The printing cartridge of claim 13 wherein said bottom surface is integrally joined with said front surface and said back along an integral hinged portion permitting limited relative movement between said bottom surface and each of said front and back surfaces.

15. The printing cartridge of claim 14 wherein said cartridge housing comprises a single piece of molded plastic.

16. The printing cartridge of claim 15 wherein one of said side surfaces curves downwardly and inwardly toward said bottom surface.

17. The printing cartridge of claim 16 wherein the inner sides of said front and back surfaces include a plurality of cooperating retaining and alignment members for securing the cartridge housing in its assembled form.

18. The printing cartridge of claim 1 having a pair of spool dividers associated with each of said spools of tape and ribbon for limiting the free unwinding of said spools.

19. The printing cartridge of claim 18 wherein said pair of spool dividers associated with said spool of ribbon includes a thin layer of paper and foam rubber on each side of said spool of ribbon.

20. A printing cartridge for supplying tape and ribbon in a printing apparatus having a printing station, said printing cartridge comprising:

a cartridge housing:

a spool of image carrying tape rotatably supported within said housing;

a spool of printing ribbon rotatably supported within said housing;

a guide means comprising an elongated member integrally joined with said cartridge housing by an integral hinge portion and adapted for limited pivotal movement with respect to said cartrigde housing about said hinge portion for guiding said tape and ribbon from said cartridge toward the printing station of said printing apparatus, said guide means including a pair of elongated guide members joined together along their opposing longitudinal edges to define an opening extending therethrough in the longitudinal direction of said elongated member for passage of said tape and ribbon, said pair of guide members being integrally joined at their ends remote from said cartridge housing by hinge portions spaced from each other for guiding said tape and ribbon as they exit from said guide means, one of said guide members further including an elongated rib integrally joined therewith and extending in a longitudinal direction of said one guide member;

first and second braking means for creating a drag on said tape and ribbon, respectively, for resisting free movement thereof from said cartridge; and a generally thin flat divider disposed within said opening and having opposite edges retained between opposing longitudinal edges of said guide members, said divider being further disposed between said tape and ribbon during their passage through said opening and between at least a portion of said elongated rib and the other of said guide members.

21. The printing cartridge of claim 20 wherein said divider is constructed of paper.

22. The printing cartridge of claim 21 wherein said divider is coated with silicone on at least one side.

23. A printing cartridge for supplying tape and ribbon in a printing apparatus comprising:

a cartridge housing;

a spool of image carrying tape rotatably supported within said housing;

a spool of printed ribbon rotatably supported within said housing;

a guide means comprising an elongated member integrally joined with said cartridge housing by an integral hinge portion and being adapted for limited pivotal movement with respect to said cartridge housing about said hinge portion, said elongated member including an opening extending therethrough in a longitudinal direction of said elongated member for passage of said tape and ribbon;

first and second braking means for creating a drag on said tape and ribbon, respectively, for resisting free movement thereof from said cartridge; and a generally thin, flat divider disposed within said opening and having opposite edges retained between opposing longitudinal edges of said guide members, said divider being further disposed between said tape and ribbon during their passge through said opening.

24. A tape and ribbon supply system for use in a printing apparatus having a printing station, said tape and ribbon supply system comprising:

a tape-ribbon cartridge;

a supply of image carrying tape supported within said cartridge;

a supply of printing ribbon supported within said cartridge; and a guide means comprising an elongated guide member for guiding said tape and ribbon, one above the other, from said cartridge toward the printing station, said guide means including means for creating a drag on said tape and ribbon for resisting free movement thereof through said guide means and means for maintaining separation between said tape and ribbon during the passage thereof through a substantial portion of the length of said elongated guide means.

25. The tape and ribbon supply system of claim 24 wherein said guide means is integrally joined with said tape-ribbon cartridge.

26. A printing cartridge for supplying tape and ribbon in a printing apparatus having a printing station, said printing cartridge comprising:

a cartridge housing;

a spool of image carrying tape rotatably supported within said housing;

a spool of printing ribbon rotatably supported within said housing;

a guide means comprising an elongated guide member integrally joined with said cartridge housing and extending outwardly therefrom for guiding said tape and ribbon, one above the other such that a first flat face of said tape is in face-to-face registration with a first flat face of said ribbon, from said cartridge toward the printing station of said printing apparatus, said elongated guide member including a pair of elongated guide sections joined together at one of their ends by end hinge means for rendering said guide sections selectively pivotable with respect to one another, one of said guide sections having its other end integraly joined with said housing and each of said guide sections having means along each of their longitudinal edges for joining said sections together along said longitudinal edges to define an opening therebetween extending through said guide means in the longitudinal direction thereof for passage of said tape and ribbon.

27. The printing cartridge of claim 26 wherein said end hinge includes a pair of hinge portions spaced from each other for guiding said tape and ribbon as they exit from said guide means.

28. The printing cartridge of claim 27 wherein one of said guide sections includes an elongated rib integrally joined therewith and extending in the longitudinal direction of said one guide section.

* * * * *

UNITED STATES PATENT AND TRADEMARK OFFICE

CERTIFICATE OF CORRECTION

PATENT NO. : 4,226,547

DATED : October 7, 1980

INVENTOR(S) : Bradshaw et al.

It is certified that error appears in the above—identified patent and that said Letters Patent is hereby corrected as shown below:

Col. 2, line 59, "botom" should read "bottom". Col. 5, line 6, "member" should read "members"; line 8, "pount" should read "pound". Col. 6, line 13, "first and second braking" should be added before the word "means" (first occurrence) and "within said guide means" should be deleted; line 14, ", respectively," should be added after "ribbon" and "of" should be deleted; line 15, "said tape and ribbon through said guide means" should be deleted and "thereof from said cartridge" should be added in its place; line 16, "maintainng" should read "maintaining"; line 25, "first braking" should be added before "means" and "and ribbon" should be deleted; line 31, "first braking" should be added before "means" and "and ribbon" should be deleted. Col. 8, line 31 "and" should be deleted; line 35, "first" should be added before "means"; line 36, "and ribbon" should be deleted; line 41, "." should be deleted and "; and" added in its place; after line 41 and before line 42, the following paragraph should be added: "second means for creating a drag on said ribbon for resisting free movement thereof from said cartridge"; line 65, "integraly" should read "integrally".

Signed and Sealed this

*Thirteenth* Day of *October 1981*

[SEAL]

*Attest:*

GERALD J. MOSSINGHOFF

*Attesting Officer*

*Commissioner of Patents and Trademarks*